US005167347A

United States Patent [19]

Wiegner et al.

[11] Patent Number: 5,167,347

[45] Date of Patent: Dec. 1, 1992

[54] MULTI-FLUID MIXING AND AUTOMATIC METERING DISPENSER

[75] Inventors: Thomas F. Wiegner, Trumbull; Gregory C. Peischl, Bethel, both of Conn.

[73] Assignee: Clairol Incorporated, New York, N.Y.

[21] Appl. No.: 688,221

[22] Filed: Apr. 22, 1991

[51] Int. Cl.[5] ..... B65D 83/14

[52] U.S. Cl. ..... 222/94; 222/136; 222/402.21

[58] Field of Search ..... 222/94.96, 105, 107, 222/136, 145, 402.21–402.23

[56] References Cited

U.S. PATENT DOCUMENTS

| | | | |
|---|---|---|---|
| 2,973,883 | 3/1961 | Modderno | 222/136 X |
| 3,217,936 | 11/1965 | Abplanalp | 222/136 |
| 3,241,722 | 3/1966 | Nissen | 222/136 |
| 3,272,389 | 9/1966 | Frangos | 222/136 |
| 3,325,056 | 6/1967 | Lewis | 222/136 X |
| 3,454,198 | 7/1969 | Flynn | 222/402.22 X |
| 3,647,120 | 3/1972 | Steiman | 222/402.22 |
| 3,690,515 | 9/1972 | Ewald | 222/402.18 X |
| 3,731,847 | 5/1973 | Webster | 222/402.21 X |
| 3,790,031 | 2/1974 | Prussin et al. | 222/136 |
| 3,982,668 | 9/1976 | Riccio | 222/136 X |

*Primary Examiner*—Andres Kashnikow
*Assistant Examiner*—Kenneth DeRosa
*Attorney, Agent, or Firm*—Anthony M. Santini

[57] ABSTRACT

This invention relates to a multi-fluid mixing and automatic mettering dispenser for co-dispensing a pressurized permanent hair dye composition, having a first container containing a hair dye and propellant material, a second container disposed within the first container and containing a dye developer material, a nozzle structure defining a discharge passageway and a valve structure having first and second valves for controlling passage of the materials through the nozzle. The nozzle structure permits concurrent operation of the first and second valves to permit simultaneous flow of the materials form the first and second containers through the discharge passageway under the influence of the propellant, such that the materials exit from the dispenser at an overall flow rate not greater than about 1.8 gm/sec, and the flow ratio of the hair dye and propellant material exiting the first valve to the dye developer material exiting the second valve is in the range of about 1.9 to 2.5:1.

3 Claims, 3 Drawing Sheets

MULTI-FLUID MIXING AND AUTOMATIC METERING DISPENSER

BACKGROUND OF INVENTION

1. Field Of Invention

This invention relates generally to manually-operated, multi-fluid dispensers, and more particularly to a dispenser in which hair dye ingredients are automatically intermixed and effectively metered before being discharged under pressure from at least two separate containers. The flow rate and flow ratio of the final composition provide the user with greater control and ease over application of the composition. Additionally, the critical dimensions of the dispenser orifices provide a precise metering system which produces a hair dye composition with superior mix (i.e. precise ratio of ingredients).

2. Status of Prior Art

A variety of materials have been packaged in containers under pressure for subsequent dispensing through a manually controlled valve outlet. In some cases, it is desirable that the product to be dispensed be formed or produced by interaction, at the time of dispensing, of two different ingredients which are stored separately from each other. Among such products are foods, paints, insecticides, cosmetic compositions, therapeutic agents, hair or skin-treating compositions, such as hot shaving preparations, hot skin cleansers, hot hair conditioning agents, and the like which typically utilize the reaction of hydrogen peroxide with one or more ingredients of the base composition for chemical development or generating heat. It is essential in the commercialization of such products that the ingredients be held in separate containers so that they will maintain their effective properties for an indefinite period of time during storage. The second component (i.e. Hydrogen Peroxide) of the composition includes whatever other ingredients are needed to complete the desired hair or skin treating composition.

Also, the dispensing device must be capable of mixing the components or ingredients in the proper proportion and in only those amounts that are required for use at one time. The valve structure of such a device should release the two ingredients in proper proportion from their containers and in a manner enabling the mixing of the two ingredients into the desired relationship. Such requirements demand precise operating characteristics of the valve structure.

Different mixing valve arrangements are shown in U.S. Pat. Nos. 2,973,883; 3,217,936; 3,241,722; 3,272,389 and 3,325,056. While these prior devices were operative in most circumstances and enjoyed various degrees of success, the valves and dispensers were either difficult to manufacture, not fully reliable when in extended use, or else lacked convenience of operation.

In addition to the foregoing drawbacks, however, many of the prior devices lacked a precise coordination of the flow through the valves even though the valves were mechanically coupled and therefore theoretically properly timed. Or, the prior devices lacked means to prevent malfunctioning of the valves if they were not mechanically coupled. The opening and flow characteristics of these different types differed considerably, whereby the coordination suffered even though there was a mechanical coupling of the valve actuators. As a result there was at times a wasteful use of the several liquids intended to be mixed.

To the inventors' knowledge, there has been no commercialized or clearly disclosed apparatus or method for effectively co-dispensing a hair dye product. In the usual procedure of carrying out the dyeing or combined bleaching and dyeing operation, the oxidative dye base is manually mixed in a container with hydrogen peroxide and applied to the hair in a manner to ensure complete saturation of the hair, including the root portions. This method is time-consuming and subject to mixing errors leading to the development of insufficient color or hair damage through the use of excess peroxide. There is an additional possibility that, for one reason or another, the composition cannot be applied to the hair immediately after mixing but only after a period of time has elapsed. Oxidation dyes are aromatic compounds of the diamine, amino phenol or phenol type. These aromatic compounds are the dye precursors which are transformed into dye agents by condensation in the presence of a significant excess of an oxidizing agent, generally, $H_2O_2$. Since the oxidative dye precursors begin to oxidize immediately upon exposure to atmospheric oxygen or hydrogen peroxide, an undesirable color effect may result if a partially oxidized composition is used.

There have been various proposals in the past for the packaging of oxidative hair dyeing compositions in pressurized dispensing devices for the purpose of obviating some of the disadvantages enumerated above. However, all suffered from the inability to provide a proper mix of ingredients, as well as a lack of control over the application of the product. The aerosolizing affect upon the dye composition produced a final product too volatile to easily handle.

It has now been discovered that, by effectively sizing the particular components of the valve assembly, the overall rate of flow of the final mixed composition can be automatically metered to provide a superior mix of hair dye ingredients, as well as the greatest control and ease over application of the final composition.

Accordingly, it is an object of this invention to provide an improved dispensing device and method in which two hair dye ingredients may be kept separate until immediately prior to use, and which releases the ingredients in a controlled discharge.

Another object of the invention is to provide a novel and improved dispensing control apparatus employing a single source of pressure for dispensing two hair dye ingredients in coordinated fashion.

Another object of the invention is to provide a novel and improved container for use in a dispensing device of the pressurized type which insures more uniform mixing and discharge of hair dye ingredients from that container.

SUMMARY OF THE INVENTION

In accordance with the present invention, there is provided a dispensing device of the pressurized type which employs at least two containers disposed in predetermined relation to one another for dispensing a hair dye composition.

The two containers include a rigid outer first container and a second container mounted within the outer container. A dye solution and propellant are in the body of the outer container and the hydrogen peroxide developer is stored in a collapsible second container partially suspended in the dye solution. The wall of the second container is of similar tubular configuration to the outer container. The pressure of the propellant within the outer container acts against the flexible wall of the second container tending to collapse the container and drive the material from the second container. Suitable materials for the collapsible tube of the second container include flexible synthetic films, such as polyethylene, polypropylene, polyamides or the like. The essential requirements of the tubing used for the second container are that it be collapsible, and substantially impermeable and inert to the components of the system. Also, the container should not be so rigid as to provide substantial resistance to compression. As propellants in this system one may use nitrogen, nitrous oxide, or the volatile hydrocarbons such as butane, isobutane, or propane.

The device has a first orifice communicating with a mixing chamber and a valve outlet common to both containers through which a mixture of the hair dye ingredients in the two containers may flow, and a second orifice associated with only the second container. A single valve unit controls the flow through both orifices for flow of the hair dye ingredients through the common outlet in a mixing operation. In the preferred embodiment, the common valve outlet and second orifice are axially aligned and the valve unit includes two valve elements which cooperate with the common outlet and second orifice, and a common biasing element disposed to urge the two valve elements into sealing relation relative to the respective common outlet and second orifice. Applied force to the valve unit moves both valve elements in coordinated movement to open the common outlet and second orifice and permit an outward flow of hair dye material in a mixing operation. Mixing of the dye solution and the hydrogen peroxide occurs in the mixing chamber upon actuation of the valve unit. The biasing element is arranged to act on the valve unit to restore the valve elements to their sealing position whenever the applied force is removed after actuation.

By maintaining the first and second orifices within particular size ranges, the invention is able to provide a superior mix and flow of hair dye ingredients. Specifically, it has been surprisingly discovered that when the first orifice is sized to have a flow rate of about 0.95–1.45 gm/sec, and the second orifice is sized to have a flow rate of about 0.45–0.7 gm/sec, and the overall flow rate does not exceed about 1.8 gm/sec, great control can be exercised over the application of the product and a uniform mixture of hair dye ingredients is produced. Ideally, the flow ratio of the first orifice to the second orifice is about 1.9 to 2.5:1, preferable 2.2:1. Typically, the hair dye passes through the first orifice, and the hydrogen peroxide developer passes through the second orifice. The flow ratio is the flow rate through the first orifice divided by the flow rate through the second orifice. The overall flow rate is the sum of the flow rates of both orifices.

In the preferred embodiment, a nozzle structure is also employed which cooperates with the two valve elements disposed within the mixing chamber to provide a common passageway in which any necessary reaction between the hair dye ingredients of the mixture is completed. The mixture exiting the nozzle is then directly applied onto the hair.

Other objects, features and advantages of the invention will be more fully disclosed in the following detailed description, which is to be considered together with the accompanying drawings wherein like numbers refer to like parts.

DETAILED DESCRIPTION OF THE INVENTION

Figure 1:
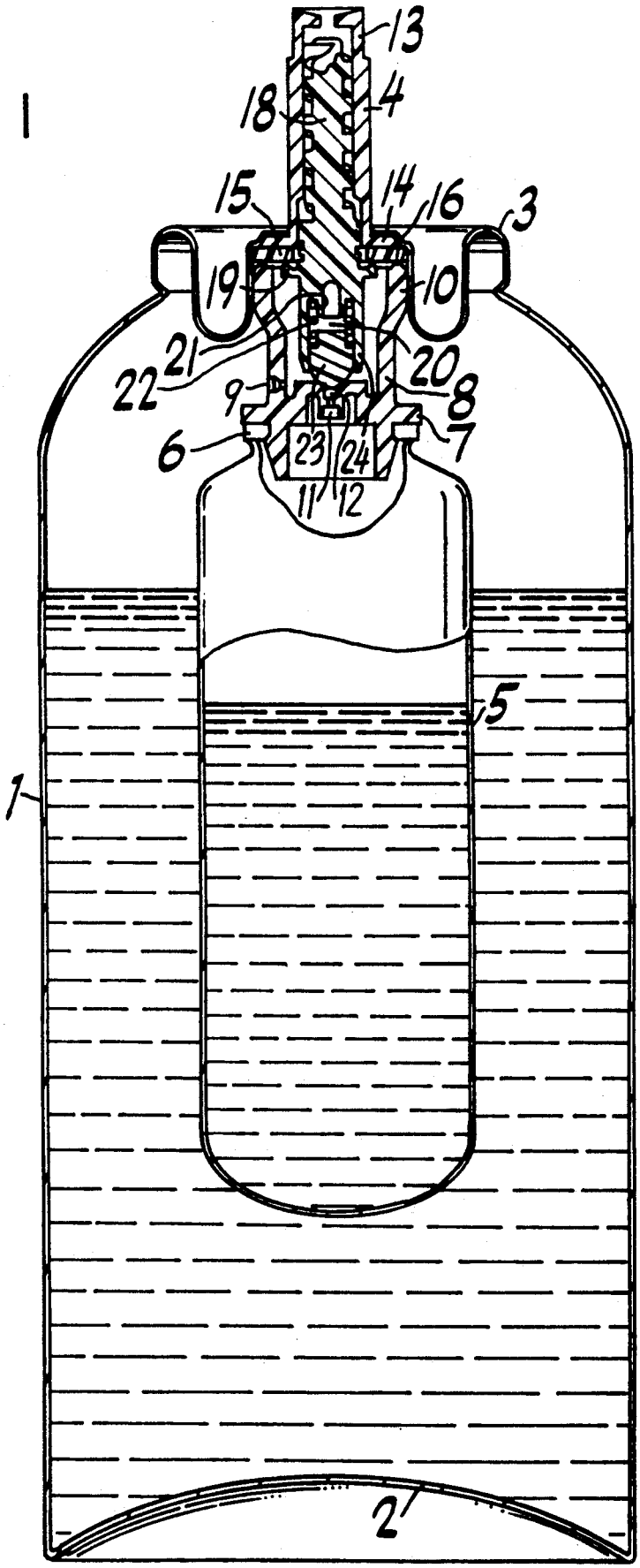
FIG. 1 is a sectional view of a multi-fluid mixing and metering dispenser constructed in accordance with the principles of the present invention.

The aerosol device shown in FIG. 1 includes a rigid, outer cylindrical container 1 having a domed bottom wall 2, a top cup 3 secured to the cylindrical outer container 1 and a discharge nozzle 4 extending upwardly therefrom. A cap may also be secured to the top cup 3 for protecting the nozzle against accidental operation. In final assembly, the outer edge of top cup 3 forms a liquid-tight and air-tight seal with outer container 1 to provide a rigid sealed container capable of storing a material to be dispensed together with a suitable propellant under pressure.

Secured to top cup 3 is a valve assembly and support that carries an inner container 5 for mounting in predetermined spaced relation within cylindrical outer container 1. The inner container 5 is a flexible, collapsible member made of a material such as polyethylene, acetate or polypropylene. It is impervious to the materials stored in the two containers. The flexibility of inner container 5 insures equalization of pressures within the inner and outer containers.

Inner container 5 is supported to the valve assembly through fixed mating between its flange 6 and flange 7 of valve housing 8. As is more clearly shown by FIGS. 1 and 3, top cup 3 and valve housing 8 comprise the top and bottom pieces, respectively, of the valve assembly and support. Valve housing 8 is sealingly connected to top cup 3 and projects downwardly therefrom. Valve housing 8 is molded of a plastic material, such as high density polyethylene. Valve housing 8 includes a lower wall portion through which a first orifice 9 extends, and an upper wall portion 10 of increased diameter about which top cup 3 is formed. Its hollow interior communicates, at its lower end through second orifice 11, with the interior of inner container 5. The first orifice is sized to have a flow rate of about 0.95–1.45 gm/sec. The second orifice is sized to have a flow rate of about 0.45–0.7 gm/sec. The overall flow rate does not exceed about 1.8 gm/sec. The flow ratio of the first orifice to the second orifice is about 1.9 to 2.5:1, preferable 2.2:1. In the lower interior wall of valve housing 8 and concentric with second orifice 11 is a valve seat structure 12 which has a seating surface of conical configuration. Seated on the top surface of the valve housing 8 is the upstanding nozzle 4 which is molded of a resilient, flexible material, such as low density polyethylene, and includes a longitudinally extending slightly tapered exit passageway 13. The base of nozzle 4 includes an outwardly extending annular base flange 14.

Gasket 15 (of greater resilience than nozzle 14) is secured between nozzle base flange 14 and upper wall portion 10. A ridge 16 of upper wall 10 compresses gasket 14 against flange 14, forming an excellent seal with top cup 3.

Disposed in the small chamber formed by valve housing 8 is valve stem 17, formed of relatively rigid material, such as high density polyethylene. Valve stem 18 includes an integrally formed mixer portion 18 of helical configuration that extends up into the nozzle exit 13 with its outer edges contacting the inner surface of nozzle 4 to form a helical discharge passageway. Valve stem 17 has an intermediate integral annular flange 19 which is adapted to bear against and form continuous annular contact with gasket 15 in the under surface of the nozzle flange 14 to thereby close the path of communication between valve housing 8 (and the outer container) and the helical discharge passageway.

The lower end of valve stem 17 is formed to define a coupling element in the form of a cylindrical chamber 20 which includes a plurality of spaced protrusions 21 at the upper end thereof. Secured by these protrusions 21 within this chamber is a compression type helical valve spring 22, the upper end of which acts to thrust the entire valve stem 17 upwardly and urges the valve flange 19 into seating and sealing engagement with the gasket 15 and nozzle flange 14 to close off the main discharge passageway. The lower end of the valve spring 22 abuts against a valve plug 23 and urges plug 23 down onto the conical valve seat 12 to close off the second orifice 11 that provides communication between inner container 5 and the mixing chamber of valve housing 8. Plug 23 is of slightly smaller diameter than the diameter of the chamber 20 that houses spring 22 so that chamber 20 may be moved down relative to plug 23 against the biasing force of spring 22.

The cylindrical skirt 24 that integrally defines the lower end of chamber 20 encircles plug 23. Lateral movement of that skirt, produced by angular tilting of the discharge nozzle structure and its associated snugly fitting internal valve stem 17, causes lateral displacement of plug 23, thereby opening the passageway leading from the inner container 5 into the discharge nozzle. When the angular displacement force on the discharge nozzle 4 is released, the resiliency of the nozzle structure in conjunction with the compressed valve spring 22 urges the plug 23 to a concentric location on conical seat 12, thereby closing second orifice 11 and preventing further flow of material therethrough.

Figure 3:
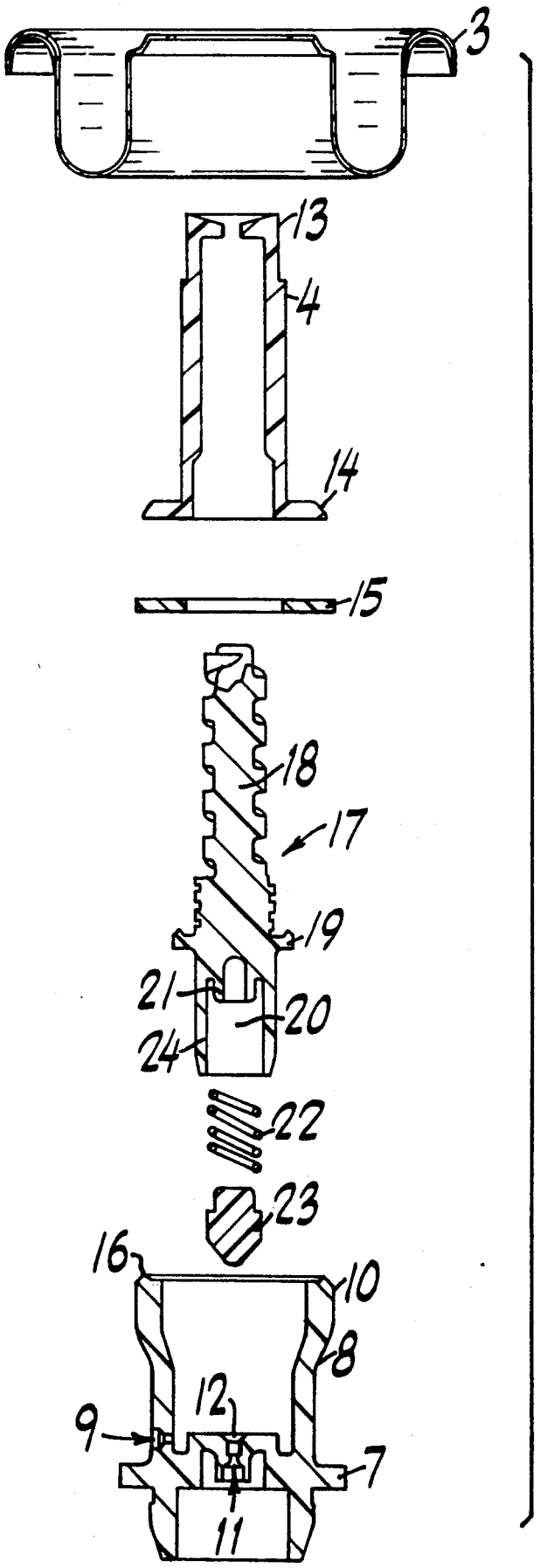
FIG. 3 is an exploded sectional view of the valve assembly of the invention.

In an assembly operation, as shown in FIG. 3, nozzle 4 is first seated against the preformed bend of the top cup 3. Gasket 15 is placed against base flange 14 of nozzle 4. The valve stem 17 is then positioned with the mixer portion 18 disposed through gasket 15 and within nozzle 4 such that valve flange 19 is sealinely compressed against gasket 15 and nozzle flange 14. Spring 22 and plug 23 are disposed as indicated relative to valve stem 17. The valve housing 8, sealingly mated to inner container 5 with hair dye developer material therein, is then seated against gasket 15 and flange 14 of the nozzle, and then the top cup 3 is formed in a crimping operation below the wall portion 10 to secure the valve assembly together. Valve plug 23 rests sealingly against conical valve seat 12. The second ingredient material (hair dye) is placed into the outer container 1, and the top cup 3 which carries the valve assembly and inner containers is then secured to the outer container 1 by spinning the edge of the top cup 3 over the top edge of the container 1 so that a sealed container capable of storing material to be dispensed and a suitable propellant under pressure is provided.

The dispensing device operates in the following manner. A solution of hair dye is in the outer container 1 together with the propellant. A developer ingredient (e.g. hydrogen peroxide) in liquid or in gaseous form is in the inner container 5 in isolation from the hair dye. The pressure applied by the propellant in the outer container 1 is applied against the flexible wall of the inner container 5 to the ingredient stored therein. To dispense a mixture of the two ingredients, the can is first inverted or tipped so that its nozzle 4 points downwardly.

Figure 2:
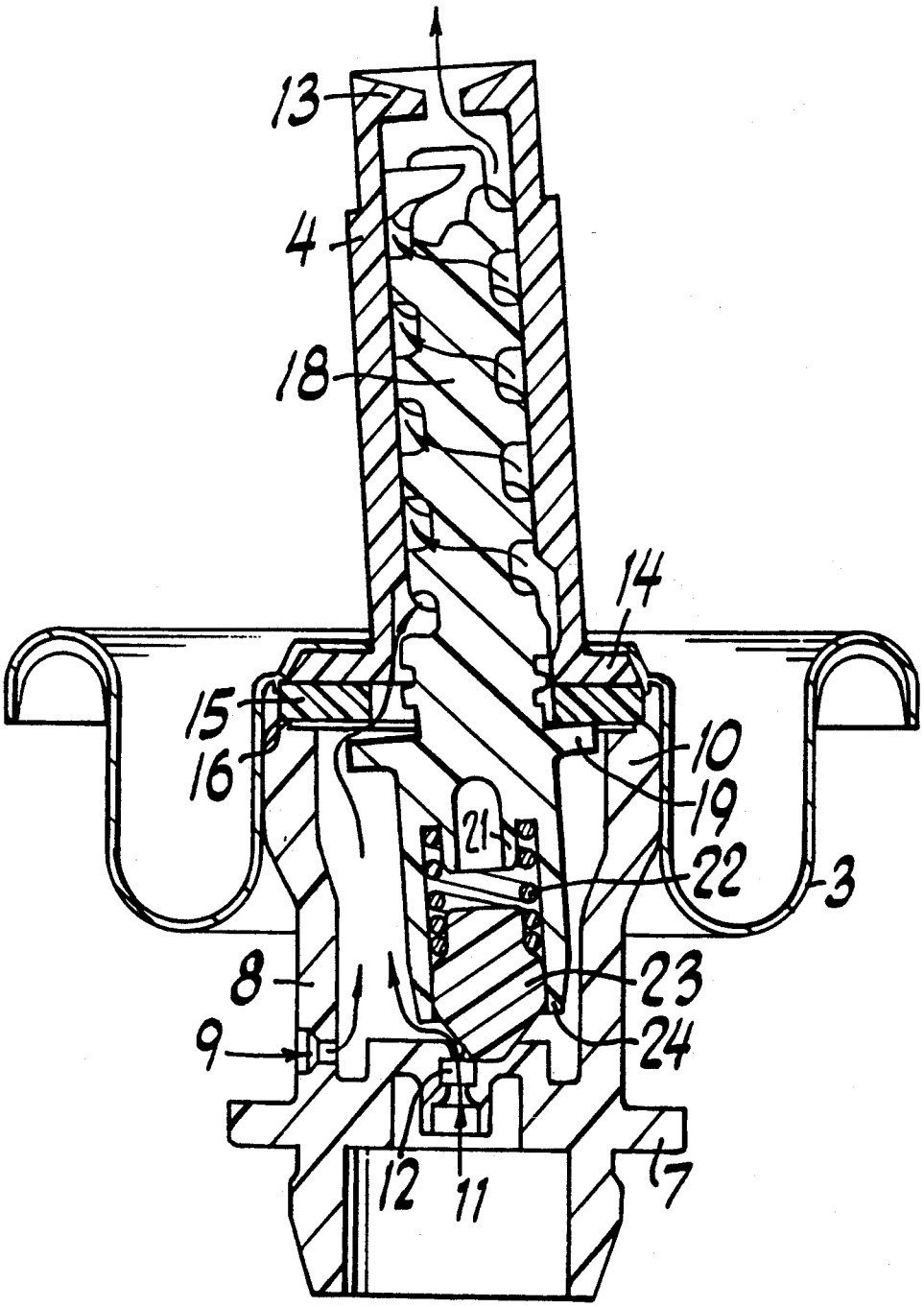
FIG. 2 is an enlarged sectional view of the valve assembly of the invention in dispensing operation.

In this position the ingredient in the outer container 1, under propellant pressure, passes continuously through first orifice 9 into the chamber of valve housing 8 and substantially fills that chamber. A lateral or tilting force is then applied manually to the discharge nozzle 4, as indicated in FIG. 2, displacing it angularly and pivoting its associated snugly fitted inner valve stem 17.

This angular displacment of valve stem 17 tilts an edge of valve flange 19 out of contact with gasket 15 thereby opening the common outlet between the chamber of valve housing 8 and the helical passageway formed by mixer portion 18 and nozzle 4 so that material will flow along the path indicated generally by the arrows.

This same angular displacement of valve stem 17 also swings coupling skirt 24, moving plug 23 laterally along conical seat 12 and opening second orifice 11 to release the developer ingredient from inner container 5. The hair dye and developer ingredients are forced out through the elongated passageway formed by helical mixer portion 18 and nozzle 4. The elongated passageway provides time for mixing of the ingredients and a chemical reaction, if necessary, to occur before discharge of the mixture from nozzle 4.

On release of nozzle 4, the spring 22, aided by the resilicency of the nozzle structure 4, acts to force the plug 23 back along the conical seat 12 in a reseating operation and also to return the valve flange 19 into complete annular seating against gasket 15 and nozzle flange 14 so that the valve assembly recovers to its original axially aligned position and both valve elements are firmly seated under the influence of the valve spring 22 and the internal pressure of the propellant, thereby terminating discharge of the ingredients from either the inner or outer containers.

The present invention provides a high degree of control over the application of the product dispensed from an aerosol container. It has now been discovered that, by effectively sizing the particular components of the valve assembly, the overall rate of flow of the final mixed composition can be automatically metered to provide a superior mix of hair dye ingredients, as well as the greatest control and ease over application of the final composition. The ease with which a product may be applied, particularly a hair dye product, is reflected by the data set forth in the following Table, wherein approximately 375 panelists who dye their hair regularly compared the present invention (with an overall flow rate not greater than about 1.8 gm/sec., a maximum flow rate of about 2.0 gm/sec. and a flow ratio of about 2.2:1) against a comparative device whose flow rate and flow ratio were outside the ranges of the present invention, but otherwise similar in design.

Panelists applied the hair dye product directly to their hair by inverting the container and activating the valve to dispense the foam dye onto their hair. The dye product was then shampooed in and throughout each panelist's hair. The dye product is representative of commercially available hair dye products such as Clairol's Ultresse®, Nice 'N Easy®, etc. Of particular import was the rate at which the product flowed and the difficulty to apply the product directly where the panelists wanted (e.g., more product at the hair roots, less product at the hair ends). After the hair dye process was completed, each panelist was interviewed by a technician to rate the different characteristics of each dispenser. The following Table provides a summary of the number of panelists (out of the 375 surveyed) that agreed with the particular attribute.

TABLE

| ATTRIBUTE | INVENTION | COMPARATIVE |
|---|---|---|
| Average Flow Rate | 1.8 gms/sec. | 2.4 gm/sec. |
| Maximum Flow Rate | 2.0 gm/sec. | 3.0 gm/sec. |
| Flowed somewhat/much too fast | 53 | 79 |
| Slightly/Not at all satisfied with application overall | 45 | 45 |
| More difficult to dispense | 41 | 49 |
| More difficult to direct where Product is wanted. | 38 | 64 |
| More difficult to use. | 34 | 41 |
| More messy to use. | 34 | 26 |
| Posses any application problem at all | 105 | 135 |

As is evident from the foregoing, the present invention achieves improved and unexpected consumer responses, particularly with respect to flow rate, degree of control and ease of application. The above data shows a 33% improvement in flow rate over the comparative device and a 41% improvement in the degree of control (i.e., difficult to direct) as compared to the other device. Thus, the inventors have discovered the painstaking parameters that will produce the improved results of the present invention. Much undue experimentation was required to arrive at the present limitations.

Accordingly, the invention provides a new and improved dispensing device from which a mixture of materials, particularly an oxidative hair dye, may be dispensed in a coordinated manner. By effectively sizing the individual orifices within the valve assembly, a product can be dispensed having superior mixture characteristics and excellent flow. The overall dimensioning of the valve assembly would not be readily obtainable or expected by the ordinarily skilled person, as much engineering of the valve assembly is required to arrive at the limitations of the present invention. Additionally, it would not be expected that such unique results in consumer response would be attained by adhering to the limitations of the present invention. Of course, it is not intended that the present invention be limited to the disclosed embodiment or to details thereof, and departures may be made therefrom within the spirit and scope of the invention as defined in the Claims.

What is claimed is:

1. A multi-fluid mixing and automatic metering dispenser for codispensing a hair dye composition under pressure comprising a first container, a hair dye and propellant material contained within said first container, a second container disposed within first said container, a hair dye developer material contained within said second container, a nozzle structure defining a discharge passageway, a valve structure for controlling passage of said materials through said nozzle, said valve structure comprising an effectively sized first orifice communicating with said first container, an effectively sized second orifice communicating with said second container, a first valve controlling the flow of material between said orifices and said discharge passageway, a second valve controlling the flow of material through said second orifice only, means for concurrent operation of said first and second valves to permit simulanteous flow of said materials from said first and second containers through said discharge passageway under the influence of said propellant, wherein said materials exit from said dispenser at an overall flow rate not greater than about 1.8 gm/sec, and further wherein the flow ratio of the hair dye and propellant material exiting the first orifice to the dye developer material exiting the second orifice is in the range of about 1.9 to 2.5:1.

2. The dispenser of claim 1 wherein the first orifice is sized to have a flow rate of about 0.95 to 1.45 gm/sec.

3. The dispenser of claim 2 wherein the second orifice is said to have a flow rate of about 0.45 to 0.7 gm/sec.

* * * * *